United States Patent [19]

Luo

[11] Patent Number: 4,968,051

[45] Date of Patent: Nov. 6, 1990

[54] TRIGGER ACTIVATED DEVICE FOR ADJUSTING THE INCLINATION OF A BACK FRAME OF A WHEELCHAIR

[76] Inventor: Chung I. Luo, No. 40, Sec. 1, Nan Ya S. Rd., Pan Chiao City, Taipei Hsien, Taiwan

[21] Appl. No.: 449,586

[22] Filed: Dec. 12, 1989

[51] Int. Cl.[5] ..... A47C 1/024

[52] U.S. Cl. ..... 280/304.1; 280/657; 297/433; 297/DIG. 4

[58] Field of Search ..... 280/304.1, 288.4, 287, 280/250.1, 647, 657; 297/DIG. 4, 433, 429

[56] References Cited

U.S. PATENT DOCUMENTS

| | | | |
|---|---|---|---|
| 2,476,769 | 7/1949 | Rideout | 297/DIG. 4 X |
| 3,198,575 | 8/1965 | Hawkins | 297/DIG. 4 X |
| 3,881,773 | 5/1975 | Rodaway | 280/250.1 |
| 4,389,070 | 6/1983 | Chien | 297/433 X |
| 4,598,944 | 7/1986 | Meyer et al. | 280/304.1 X |
| 4,655,471 | 4/1987 | Peek | 297/DIG. 4 X |
| 4,893,827 | 1/1990 | Gay et al. | 280/250.1 |

*Primary Examiner*—Charles A. Marmor
*Assistant Examiner*—Alan M. Kager
*Attorney, Agent, or Firm*—Merchant, Gould, Smith, Edell, Welter & Schmidt

[57] ABSTRACT

A trigger activated device for adjusting the inclination of a back frame of a wheelchair including a pair of adjusting assemblies provided on each of two sides of the back frame. Each adjusting assembly includes a horizontally disposed support which is fixed to a rear portion of a seat frame of the wheelchair. A back member is pivotally attached to the support. A threaded bar is pivotally attached to the back frame. A handgrip is attached to an upper portion of the back member. A trigger device disposed under the handgrip. A T-shaped hollow tube having a lug formed at one end thereof includes a first section and a second section protruding from a middle portion of the first section. The T-shaped hollow tube is pivotally mounted on a free end of the support via the lug. The threaded bar passes through the first section of the T-shaped hollow tube. An end cap is provided at a free end of the second section of the T-shaped hollow tube. An engaging block having serrations provided at a first end thereof is provided in the second section. The serrations engages with threads of the threaded bar. A second end of the engaging block is attached to a first end of a cable penetrating the end cap. A second end of the cable is attached to the trigger device. A return spring is provided between the end cap and the second end of the engaging block.

1 Claim, 4 Drawing Sheets

TRIGGER ACTIVATED DEVICE FOR ADJUSTING THE INCLINATION OF A BACK FRAME OF A WHEELCHAIR

BACKGROUND OF THE INVENTION

The present invention relates to a trigger activated device for adjusting the angle of inclination of the back frame of a wheelchair.

Wheelchairs are a very important mode of transportation for hospital patients as well as permanently or temporarily disabled people. One particular function of wheelchairs is to provide a reclining seat to allow a passenger to rest comfortably. In order to achieve such of function, the wheelchair is designed to adjust the inclination of the back frame.

Wheelchairs of this type have several grooves formed on a rear side of the back frame, which cooperate with a cross bar provided below the back frame to provide a stage-type adjustment of inclination of the back frame. Nevertheless, that the passenger must abandon the seat of the wheelchair during the adjusting in inclination is extremely inconvenient. Furthermore, it is particularly impossible to make such adjustment with a serious ill or disabled passenger.

SUMMARY OF THE INVENTION

It is therefore an object of the present invention to provide a trigger activated adjusting device for adjusting the inclination of the back.

It is another object of the present invention to provide a trigger activated device for smooth and easy adjustment in inclination of the back of a wheelchair.

These and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENTS

Referring to FIGS. 1 to 4, a trigger activated device according to the present invention is coupled with a wheelchair 1 to provide the adjustment of the inclination of the back frame of the wheelchair 1.

Figure 1:
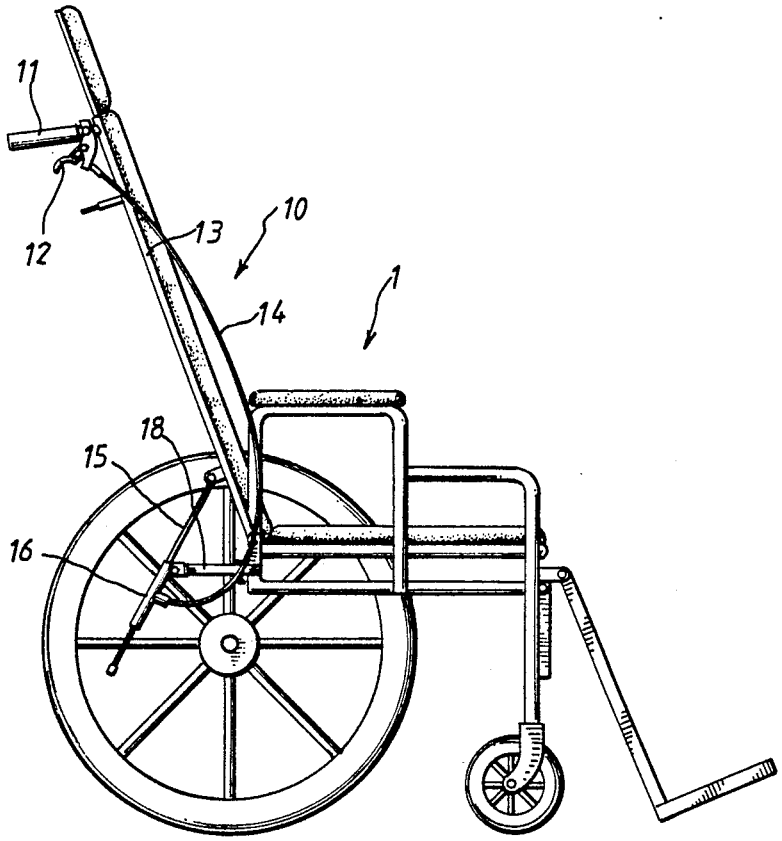
FIG. 1 is a side view of a trigger activated device for adjusting the inclination of the back of a wheelchair in accordance with the present invention applied on a wheelchair.
Figure 2:
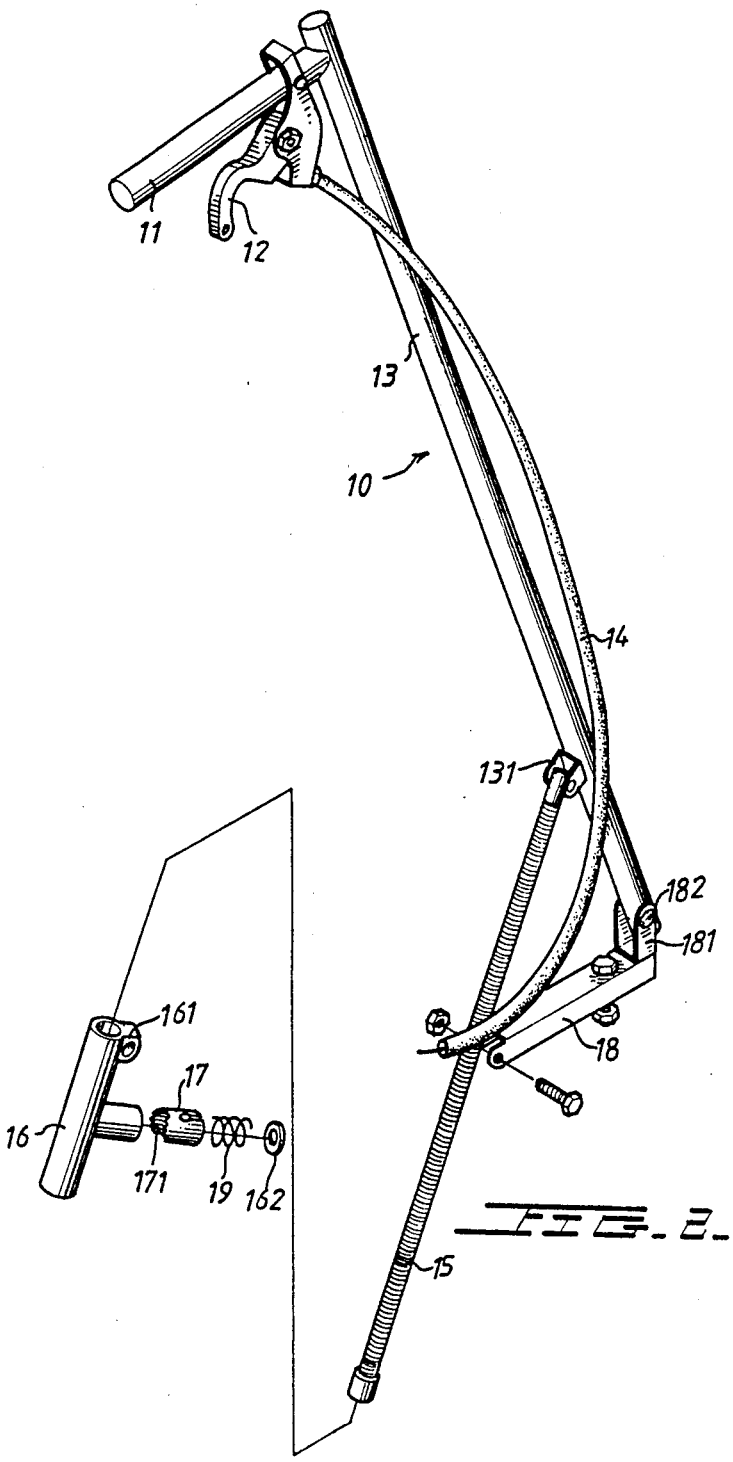
FIG. 2 is an exploded perspective view of a trigger activated device in accordance with the present invention.
Figure 3:
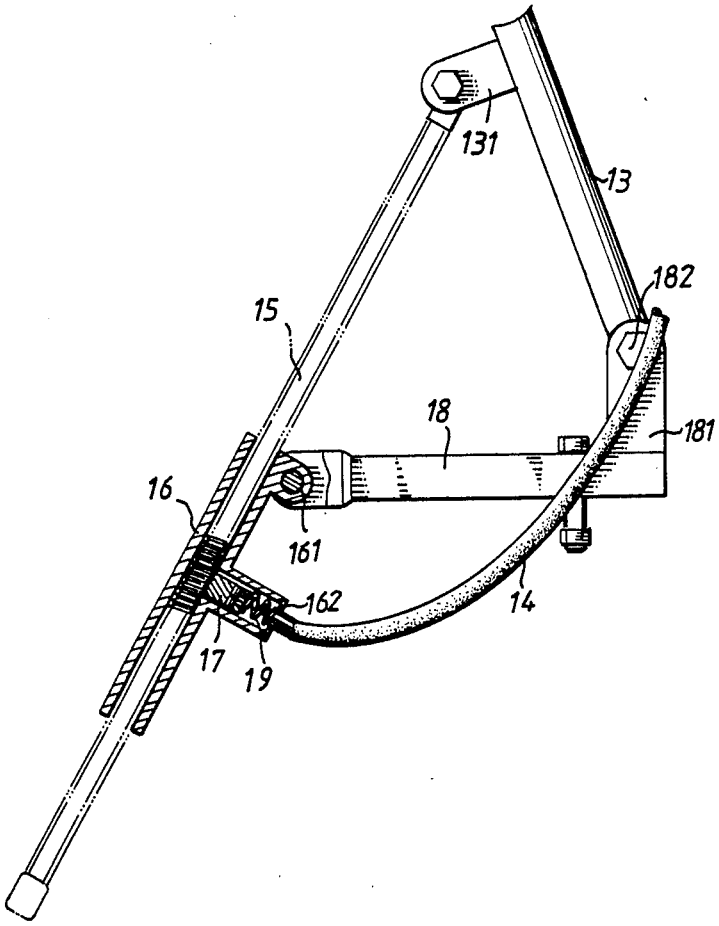
FIG. 3 is a partial cross-sectional view of a trigger activated device in accordance with the present invention showing the engagement of an engaging block and a threaded bar for fixing the back frame of a wheelchair.

The trigger activated device comprises a pair of adjusting assemblies 10 provided on each of two sides of the back frame. Referring now to FIGS. 2 and 3, each adjusting assembly 10 comprises a horizontally disposed support 18 with one one end thereof fixed to a rear portion of a seat frame of the wheelchair 1. A first U-shaped prop 181 extends upwardly from the support 18 adjacent to the fixed end of the support 18.

As shown in FIGS. 2 and 3, a back member 13 is pivotally mounted on the first U-shaped prop 181 at a first end thereof by means of a pin 182 located at an upper portion of the first U-shaped prop 181 and transverse to a length of the support 18. A second U-shaped prop 131 is attached to the member 13 at a lower portion thereof. A threaded bar 15 at a first end thereof pivotally attaches to the second U-shaped prop 131.

Generally, the handgrip 11 of the wheelchair attaches to an upper portion of the back member 13. A T-shaped hollow tube 16 formed with a lug 161 at one end thereof comprises a first section with a second section protruding from a middle portion of the first section. The T-shaped hollow tube 16 is pivotally mounted on a free end of the support 18 by means of the lug 161. The threaded bar 15 passes through the first section of the T-shaped hollow tube 16. An end cap 162 is provided at a free end of the second section of the T-shaped hollow tube 16. An engaging block 17 having serrations 171 provided at a first end thereof is provided in the second section. The serrations 171 engage threads of the threaded bar 15. A second end of the engaging block 17 is attached to a first end of a cable 14 penetrating the end cap 162. A return spring 19 is provided between the end cap 162 and the second end of the engaging block 17.

A trigger means 12 is disposed beneath the handgrip 11. A second end of the cable 14 is attached to the trigger means 12. The serrations of the engaging block 17 are actuated to disengage from the threaded bar 15 by means of the cable 14 such that the back member 13 of the back frame is pivotable during triggering of the trigger means 12. At the same time, the return spring 19 is compressed by the engaging block 17.

Figure 4:
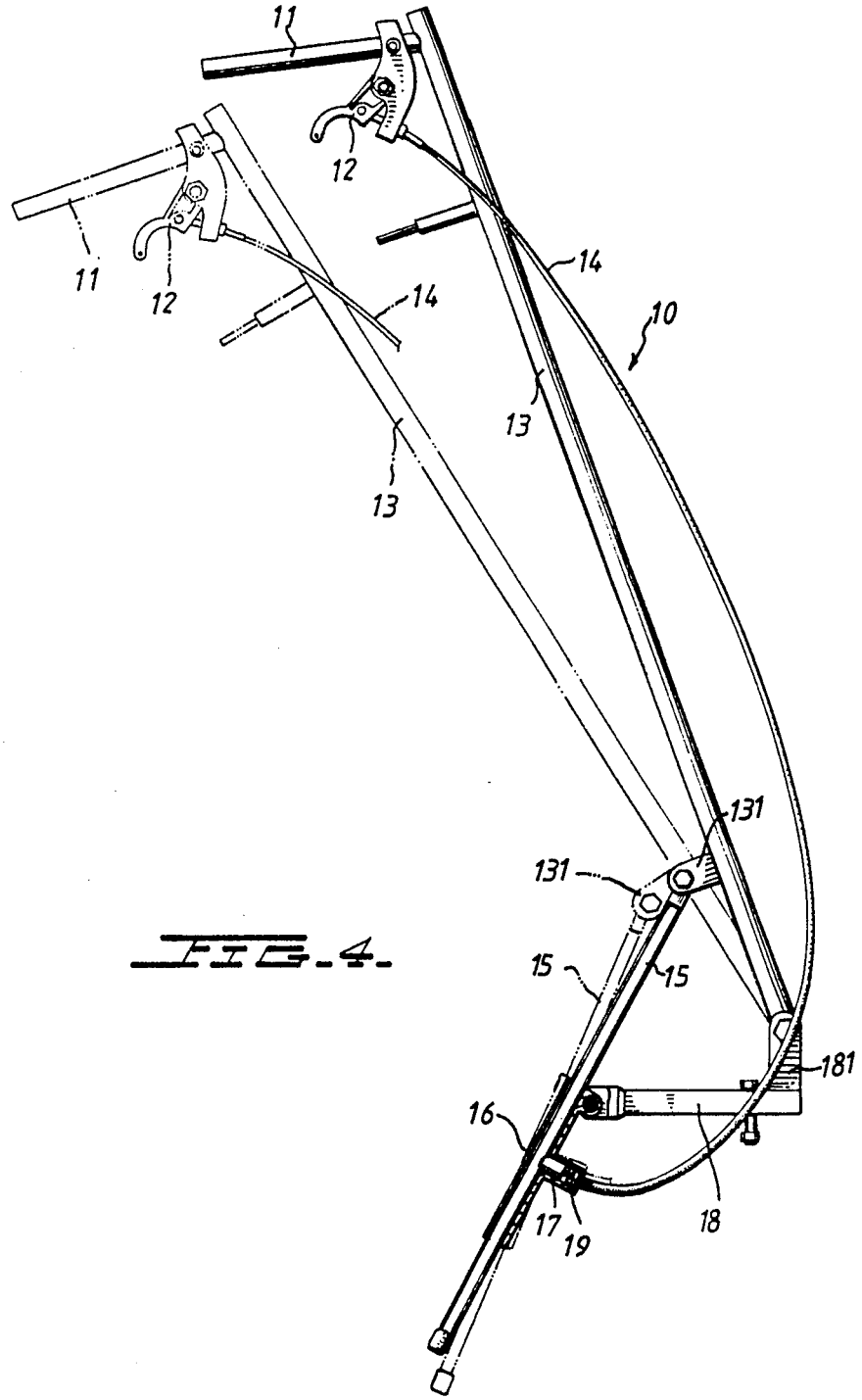
FIG. 4 is a cross-sectional view of the trigger activated device according to the present invention showing the adjusting motion of the back frame of a wheelchair.

As shown in FIG. 4, if a wheelchair passenger needs to lay down or sit up by adjusting the inclination of the back frame, a second party while holding the handgrip 11 can trigger the trigger means 12 with his index finger. Then he can lift up or, alternatively, push down both the handgrips 11 to pivot the back member 13 to the desired position (for example, to the position shown by the phantom line in FIG. 4). Then releasing trigger means 12, the serrations 171 of the engaging block 17 return to their original positions to engage with and fix the threaded bar 15 by means of the return spring 19. Accordingly, the wheelchair according to the present invention provides for the smooth adjustment of the inclination of the back frame to allow a passenger to rest at any desired inclination.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A trigger activated device for adjusting inclination of a back frame of a wheelchair, comprising a pair of adjusting assemblies provided on each of two sides of said back frame, each said adjusting assemblies comprising:

a horizontally disposed support with one end thereof fixed to a rear portion of a seat frame of the wheelchair, a first U-shaped prop extending upwardly from said support adjacent to said fixed end of said support;

a back member being pivotally mounted on said first U-shaped prop at first end thereof by means of a pin located at an upper portion of said first U-shaped prop and transverse to a length of said support, a second U-shaped prop being attached to said back member at a lower portion thereof, a threaded bar being pivotally attached to said second U-shaped prop at a first end thereof;

a handgrip being attached to an upper portion of said back member;

a T-shaped hollow tube having a lug formed at one end thereof, said T-shaped hollow tube comprising a first section formed with a second section protuding from a middle portion of said first section, said T-shaped hollow tube being pivotally mounted to a free end of said support via said lug, said threaded bar passing through said first section of said T-shaped hollow tube, an end cap being provided at a free end of said second section of said T-shaped hollow tube, an engaging block having serrations provided at a first end thereof being provided in said second section, said serrations engaging with threads of said threaded bar, a second end of said engaging block being attached to a first end of a cable penetrating said end cap, a return spring being provided between said end cap and said second end of said engaging block; and a trigger means being disposed under said handgrip, a second end of said cable being attached to said trigger means, said serrations of said engaging block being actuated to disengage from said threaded bar via said cable such that said back member is pivotable during triggering of said means such that said return spring is compressed by said engaging block, when said trigger means is released, said serrations of said engaging block return to their original positions to engage with and fix said threaded bar by means of said return spring.

* * * * *

UNITED STATES PATENT AND TRADEMARK OFFICE

CERTIFICATE OF CORRECTION

PATENT NO. : 4,968,051

DATED : November 6, 1990

INVENTOR(S) : Chung I. Luo

It is certified that error appears in the above-identified patent and that said Letters Patent is hereby corrected as shown below:

| | |
|---|---|
| Abstract, line 10: | After "device" insert --is-- |
| Col. 1, line 15: | "of" should be --a-- |
| Col. 1, line 68: | Delete "one" (first occurrence) |
| Col. 4, line 16: | Before "means" insert --trigger-- |

Signed and Sealed this

Twenty-first Day of July, 1992

*Attest:*

DOUGLAS B. COMER

*Attesting Officer*

*Acting Commissioner of Patents and Trademarks*